US005961282A

United States Patent [19]

Wittrisch et al.

[11] Patent Number: 5,961,282

[45] Date of Patent: Oct. 5, 1999

[54] AXIAL-FLOW AND CENTRIFUGAL PUMPING SYSTEM

[75] Inventors: Christian Wittrisch, Rueil Malmaison; Marcel Arnaudeau, Paris; Eric Vandenbroucke, Rueil Malmaison, all of France

[73] Assignee: Institut Francais du Petrole, Rueil-Malmaison, France

[21] Appl. No.: 08/852,566

[22] Filed: May 7, 1997

[30] Foreign Application Priority Data

May 7, 1996 [FR] France ..... 96 05737
May 2, 1997 [FR] France ..... 97 05471

[51] Int. Cl.[6] ..... F01D 1/02; F03B 1/04; F03D 1/04

[52] U.S. Cl. ..... 415/199.6; 415/901; 415/199.2

[58] Field of Search ..... 415/112, 143, 415/176, 198.1, 199.6, 199.5, 901, 199.1, 199.2; 417/424.1, 424.2, 423.5

[56] References Cited

U.S. PATENT DOCUMENTS

| | | | |
|---|---|---|---|
| 1,491,150 | 4/1924 | Layne et al. | 415/112 |
| 3,143,103 | 8/1964 | Zuhn | 415/199.6 X |
| 3,303,989 | 2/1967 | Rurik et al. | 415/143 |
| 4,215,976 | 8/1980 | Neumann | 417/409 |
| 4,276,002 | 6/1981 | Anderson | 415/112 X |
| 4,523,900 | 6/1985 | Frey | 415/143 X |
| 4,693,669 | 9/1987 | Rogers, Sr. | 415/199.6 X |
| 5,628,616 | 5/1997 | Lee | 415/199.1 X |

FOREIGN PATENT DOCUMENTS

| | | | |
|---|---|---|---|
| 890117 | 6/1949 | Germany | 415/199.6 |
| 888207 | 7/1949 | Germany | 415/143 |

*Primary Examiner*—John E. Ryznic
*Attorney, Agent, or Firm*—Antonelli, Terry, Stout & Kraus, LLP

[57] ABSTRACT

A system for compressing a multi-phase fluid made up of at least one gaseous phase and at least one liquid phase, the system having at least one pair of pumping elements. The system includes an axial-flow pump P1 and a centrifugal pump P2 arranged after the axial-flow pump P1. The two elements are linked by an element which adjusts the fluid from the axial-flow pump to optimize the effect of the centrifugal pump.

7 Claims, 3 Drawing Sheets

AXIAL-FLOW AND CENTRIFUGAL PUMPING SYSTEM

BACKGROUND OF THE INVENTION

The present invention relates to a system which is capable of imparting a sufficient energy or power value to a multi-phase fluid comprising at least one gaseous phase and at least one liquid phase to transfer it from one location to another.

The system of the invention is based on an axial-flow (multi-phase) pump design which is adapted to a centrifugal pump and makes use of a synergetic effect combining the effects of each of the elements, which broadens the operating range and operation (gain in power or output) as compared with conventionally used pumping systems.

A system of this type will have the capacity to pump any type of effluent, irrespective of its gas to liquid ratio (GLR for short).

The concept axial-flow pump is also used to refer to multi-phase pumps adapted to pump fluids made up of several phases of different natures.

The present invention advantageously finds its application, although not exclusively so, in pumping from oil wells where the petroleum effluent consists of at least one gaseous phase and a liquid phase (made up of an aqueous phase and/or an organic phase, for example) and possibly solid particles.

With the methods of the prior art, a petroleum effluent is usually transferred from the bottom of the well to the surface by means of a centrifugal pump lowered into a bore and commonly known as a "down-hole pump". The majority of these pumps have several stages incorporating an impeller, the purpose of which is to impart a pressure-induced power and kinetic energy to the fluid, and an adjusting device whose function is to convert this high-velocity kinetic energy into a low-pressure energy bringing the fluid as close as possible to the axis or rotary shaft of the pump.

An impeller and an adjuster or diffuser represent one stage and throughout the description the word "stage" will be used to designate a unit consisting of a pair comprising an impeller and a diffuser, irrespective of whether the pump is of the axial or centrifugal type.

Similarly, the angles $\alpha$ and $\beta$ defined in the description below are considered with respect to a plane perpendicular to the axis of the rotation shaft.

In practice, centrifugal pumps have a disadvantage in that their operating range is limited. In effect, these pumps are suitable for compressing fluids which are essentially liquid but once there are more than a few percent of gas present in the fluid they no longer transfer energy to the fluid as well as they might.

The characteristics of pumping systems of the axial-flow type are such that energy is imparted to an effluent consisting of several phases of different natures, a gaseous phase and a liquid phase, but they are not capable of producing a gain in pressure per unit of identical length when the fluid is mainly in liquid form, such as that produced when using a centrifugal pump.

SUMMARY OF THE INVENTION

The objective of the present invention, therefore, is to overcome the disadvantages of each of these axial and centrifugal elements of the prior art and produce a pumping system using a specific adaptation and design of these two types of elements which has the capacity to handle any type of fluid and, in addition, produce gains in pressure per unit of length in excess of what would be produced using the devices of the prior art.

Furthermore, the operating range of the pumping system is broadened whilst obtaining improved compression of a multi-phase fluid.

The system can be used for pumping from the bottom of a well but also for pumping at the surface.

It should be noted that the expression "multi-phase fluid" is intended to mean a fluid which contains at least one gaseous phase and at least one liquid phase, which might be an aqueous phase and an organic phase, for example, and possibly also solid particles such as grains of or mud.

The object of the present invention is a system which will allow a multi-phase fluid comprising at least one gaseous phase and at least one liquid phase to be compressed so that it can be transferred from one location to another. It is characterised in that it has in combination at least one pair of pumping elements comprising:

- a first pump P1 of the axial-flow type, designed to impart power to the said multi-phase fluid and/or reduce the proportion of gaseous phase initially present in the fluid and/or mix the gaseous and liquid phases in order to produce a first fluid F1 with an power El at the output of the first pump, the fluid F1 being delivered to a second pump P2,
- a second pump P2 being of the centrifugal type, and being disposed after the said first pump P1, this second pump P2 being capable of imparting to the first fluid F1 from the first pump P1 a pressure value which is sufficient to transfer it from one location to another, for example from a production source to a collection and/or processing point.

In one embodiment, the pumping system comprises an element arranged between the output of the said first pump P1 and the input of the said second pump P2, whose geometric and dimensional features are designed to adjust the fluid flow in order to optimize its transfer from the axial pump to the centrifugal pump.

The pumping elements or pumps P1 and P2 may be joined to a same rotary shaft.

The axial pump P1 may have several stages, each of the stages comprising an impeller and a rectifier. The geometric characteristics of the element used to adjust the effluent are such that the entry angle $\alpha$ and the exit angle $\beta$ and/or the values of the average flow diameters (Di, De) with respect to the input and output of the said element are optimized to transfer the fluid F1 to the second pump P2.

In a preferred embodiment of the system of the invention, the angle $\alpha$ is between 10 and 30° and the angle $\beta$ is essentially 90°.

The value of the ratio of the average flow diameters Di/De ranges between 1.8 and 2.5, for example, and preferably approximately 2.

In a preferred embodiment of the invention, the intermediate element is an adjuster element disposed between the impeller of the previous stage of the pump P1 and the first impeller of the pump P2.

In one particular embodiment of the system, the rotation shaft A consists of at least two parts A1 and A2, one part A1 being of a length L1 essentially equal to the length of the axial-flow pump and a second part A2 being of a length L2 which extends substantially across the entire length of the centrifugal pump P2, the value of the diameter D1 of the portion A1 being greater than the value of the diameter D2.

Advantageously, the rotation shaft A may have means for drawing off at least some of the high-pressure fluid and means for re-injecting the said drawn-off fluid on a level with one or more adjusting devices of the axial pump P1 in order to lubricate the bearing or bearings of an adjusting device.

The drawing-off and re-injecting means consist of a tube arranged in a cavity of the rotation shaft, for example, the said tube having passage means distributed such that they will lubricate the bearings of the adjusting devices.

The system of the invention is particularly well suited to installation in a petroleum well and can therefore be used to transfer a multi-phase fluid from the bottom of the well to the surface.

It would not be a departure from the scope of the invention if the system were to be used in any location where it is necessary to impart power to a multi-phase fluid in order to be able to transfer it from one location, such as a source, to a point of destination such as a collection or processing station.

BRIEF DESCRIPTION OF THE DRAWINGS

Other advantages and features of the invention will become clear from the following description of embodiments given by way of illustration in the context of applications, which are not restrictive in any respect, where a multi-phase effluent of the petroleum type, consisting of at least one liquid phase, one gaseous phase and possibly a solid phase, is compressed or pumped, with reference to the appended drawings, in which.

DETAILED DESCRIPTION OF THE PREFERRED EMBODIMENTS

In order to provide as clear as possible an understanding of the invention and by way of illustration but not restrictive in any respect, the following description relates to a pumping system in a petroleum well consisting of at least one pair comprising a pumping element P1 or axial-flow pump and a pumping element P2 or centrifugal pump, the two pumps being arranged relative to one another and linked by an adjuster element to bring the petroleum effluents from the bottom of the well to the surface.

The surface may, of course, be the sea bed in a sub-sea application or it may be the ground in the event of onshore production.

Figure 1:
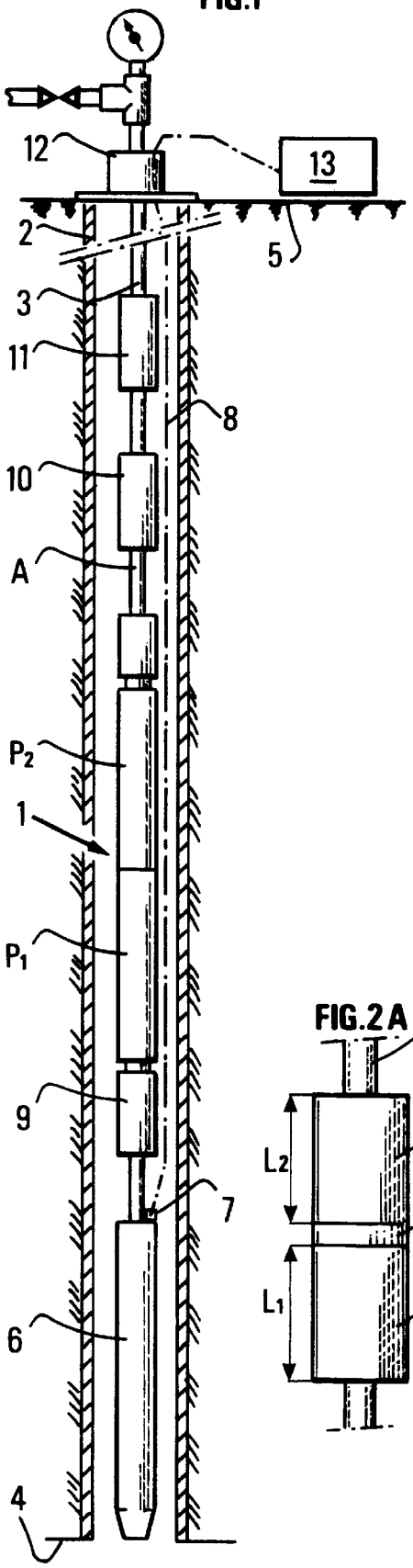
FIG. 1 illustrates a specific application of the pumping system arranged in a petroleum well, consisting of a pair comprising a pumping element of the axial-flow type and a pumping element of the centrifugal type.

FIG. 1 describes an example in which the pumping system 1 has an axial-flow pump P1 linked to a centrifugal pump P2, which can be lowered at a given point through a production casing 2. An example of the arrangement and configuration of the pumps is illustrated in detail in FIGS. 2A and 2B. The pumping system 1 is suspended on the end of a production tubing 3, for example.

The unit lowered down the well in this way, where 4 is a point corresponding to the bottom of the well and 5 is a point corresponding to the surface to which the effluent is to be transported, consists, for example, of:

- an electric motor 6 to drive the pumping system 1, the motor 6 preferably being positioned on the admission side of the axial-flow pump P1 making it easier to cool the motor by means of the effluent passing as it enters the pump, which corresponds to the lower portion of the pump when the system is used vertically. In some cases, it may be preferable to use a hydraulic turbine where the fluid used is sea water, a petroleum crude or possibly a high-pressure fluid taken from an external source,
- a connector element 7 providing the electrical connection by means of a power cable 8 running up to the surface and connected to a device 13, such as a control box distributing the requisite power to run the system. The cable may also be used to convey down-hole data, in which case it will be connected to an appropriate device,
- the connector element 7 has another function in that it provides a seal between the electric motor, which is lubricated by oil, so as to prevent any oil from getting into the pumping system 1,
- a protective element 9 arranged above the element 7 to ensure that the pumping system is completely sealed off,
- a non-return valve 10 and a purging valve 11 arranged on the side of the centrifugal element P2 at the output of the element. Since the skilled person will be familiar with these two elements, they will not be described in detail.

At the level of the surface 5, a special tubing head 12, fitted with seals, for example, is used to run the power cable 6 to the exterior and to the control panel.

Advantageously, an adjustable nozzle (not illustrated in the drawing) can be used to adjust the flow by increasing or decreasing the counter-pressure on the pumping system.

Figure 2A:
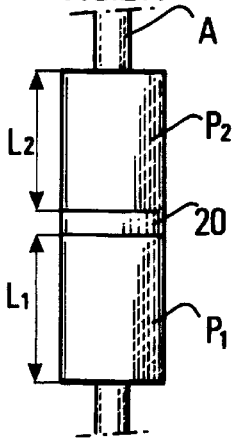
FIGS. 2A and 2B illustrate schematically how the two elements of the pair of FIG. 1 are disposed on a same rotation shaft and provide a detail of the intermediate element designed to operate in conjunction with these two pumping elements.

FIG. 2A illustrates schematically how the two pumping elements P1 and P2 are joined to a same rotation shaft A and separated by an intermediate element designated by reference 20 or adjuster element, the function of which is to ensure that the fluid is transferred from the axial-flow pump to the centrifugal pump.

In the embodiment illustrated in FIG. 1, the multi-phase fluid from the production well first enters the axial-flow pump P1 and then passes through the centrifugal pump P2.

Figure 2B:
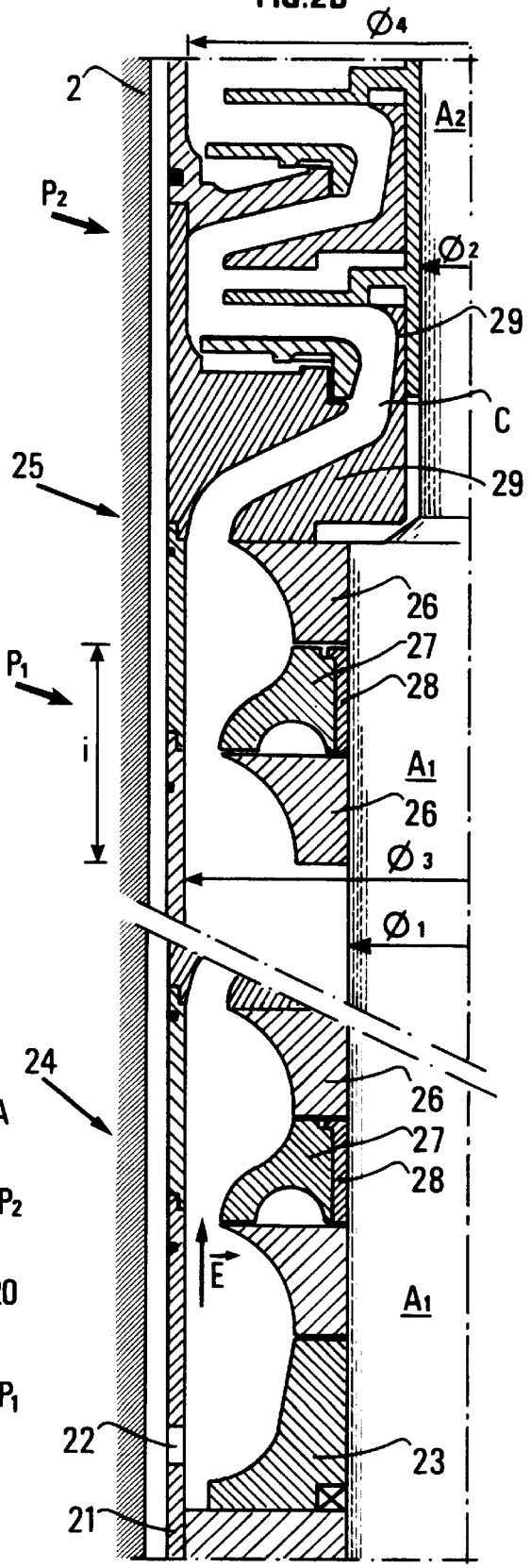

In FIG. 2B, only those specific elements which will provide an understanding of the invention will be mentioned, whilst those elements specific to centrifugal pumps and familiar to the skilled person are, for example, not shown.

FIG. 2B is a half-diagram showing an example of the design of the pumping system, which consists of the pump P1 of the axial-flow type of a length L1 and the pump P2 of the centrifugal type of a length L2 in a same housing 21. The housing 21 is preferably cylindrical so that it can be more readily inserted in a well. This housing is provided with at least one inlet orifice 22 for the fluid and a discharge orifice (not illustrated in the drawing in order to retain clarity), arranged at the output of the centrifugal pumping device and communicating with a fluid flow circuit taking the fluid to the surface 5.

In the example illustrated in this drawing, the intake orifices 22 are protected ports in the wall of the housing 21, for example, and the device has, at least on a level with these orifices, a deflector 23 integral with the housing 21 to deflect the flow and impart to it a velocity with an essentially axial direction, i.e. parallel with the axis of the pump.

In view of the transmission of forces relative to the motor, it is preferable to use a rotation shaft A with several portions of different diameters selected to suit the type of pump (centrifugal or axial-flow). The rotation shaft A is therefore arranged inside the housing 21 and has at least two portions A1 and A2 with respective diameters of Φ1 and Φ2.

The axial-flow part P1 of the system has several compression stages i, for example, one stage of which is an aspiration or admission stage 24, and an output stage. The number of these stages is selected to suit the amount of power needed to convey the effluent from the bottom of the well to the centrifugal pump. Each compression stage has an impeller 26 and an adjuster 27, for example, the geometric characteristics and dimensions of which are selected and adapted to suit the nature of the multi-phase effluent. The impeller 26 is joined to the shaft by means of a key 56 (FIG. 6) and the adjuster 27, joined to the body of the pump, is guided relative to the rotation shaft by means of an integral bearing 28, one part of which is joined to the rotation shaft A1.

The geometric and size specifications of the hydraulics (impeller and adjuster) of the axial-flow pump P1 are similar to those described in patents FR 2.333.139, FR 2.471.501 and FR 2.665.224 filed by the present applicant, for example- They are specifically designed to:

reduce the proportion of gaseous phase and/or mix the different phases making up the effluent, particularly the gaseous phase and the liquid phase, so that the facies or structure of this flow is compatible with the centrifugal pumping element located downstream and/or ensure that the effluent is sufficiently compressed to at least a pressure level Pe needed to enter the pump.

The centrifugal portion P2 is a multi-stage centrifugal pump, for example, comprising a number of compression stages, this number being determined such that it will produce the desired delivery height and hence ensure that the pressure value F1 of the effluent is sufficient to allow it to be compressed and brought up to the surface. This pump is provided with an outlet orifice communicating with the pipe that will bring the effluent up to the surface.

Arranged between these two elements P1 and P2 is an intermediate element 20, the function of which is to adapt the fluid characteristics, in particular its flow direction, its flow diameter and any other relevant parameter that might be pertinent to the centrifugal pump P2.

In order to obtain an optimum synergetic effect between the two elements P1 and P2, the intermediate element has specific geometric and dimensional characteristics which will be described below. In the embodiment illustrated in FIG. 2B, the intermediate element is the adjusting device 29 disposed after the impeller 26 of the last stage 25 of the pump P1.

Figure 3:
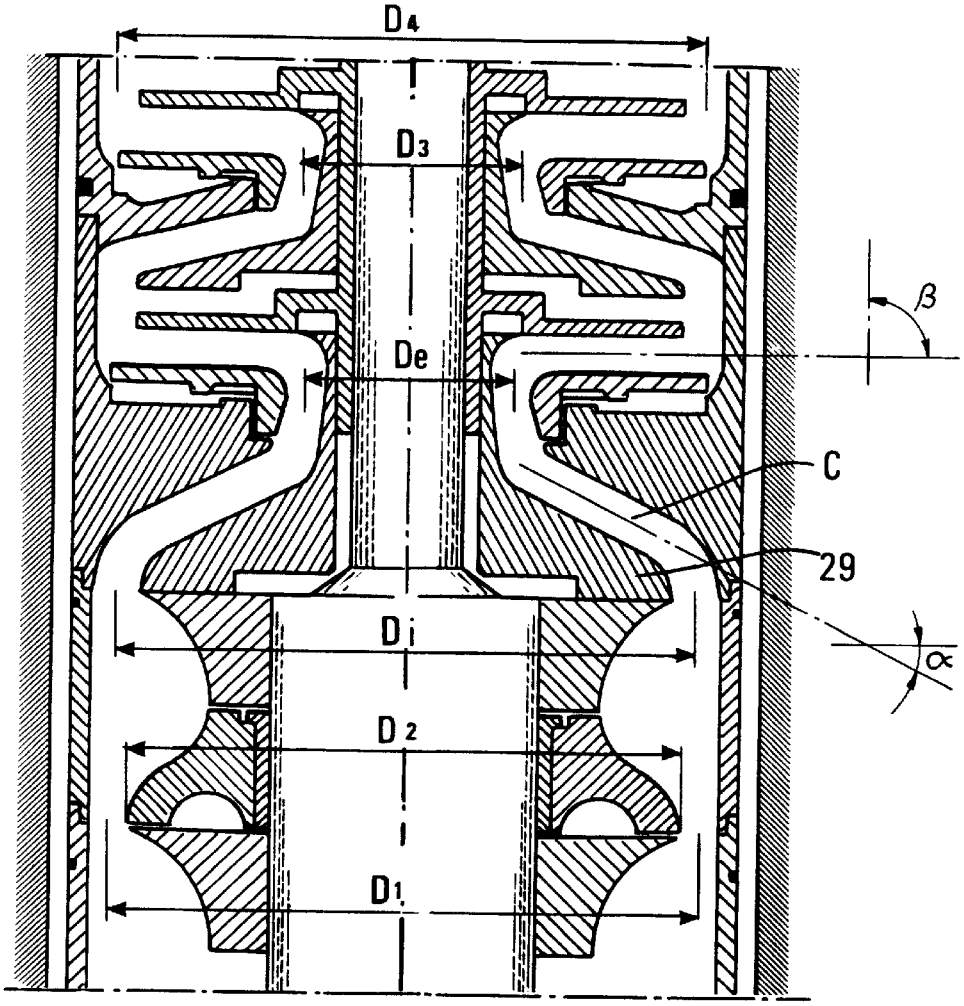
FIG. 3 shows the average flow diameters within the intermediate element.

FIG. 3 is a schematic illustration providing a reminder of how the average flow diameter of a fluid in compression devices is defined, well known to those skilled in the art, for the adjusting device 29, in which reference Di denotes the average flow diameter at the inlet of the adjuster 29 and De the average flow diameter at the outlet.

This drawing also shows the average flow diameters defined for centrifugal and axial-flow pumps. The references for the different elements are as follows:

the diameter values for the axial-flow pump given for the inlet and outlet respectively are shown by references D1 and D2 and for the centrifugal pump by D3 and D4.

Being located after the impeller 26 of the last stage 25, the characteristics of the entry and exit angles of the adjuster 29 are as follows:

the angle of entry α to the adjusting device, taken relative to the plane perpendicular to the axis of the rotation shaft A1, is between 10 and 30°, the angle of exit β taken relative to the same plane is within a range of 90 +/−10 °.

The shape of the flow passage C inside this rectifier 29 is designed so as to promote the change in the flow direction of the fluid from the angle α to the angle β and hence to adjust the direction which the fluid assumes at the outlet of the pump P1 to match the geometric characteristics at the inlet of the pump P2 in order to obtain the best possible compression inside the centrifugal pump P2.

In order to produce this result, the value of the ratio (Di/De) of the average passage flow diameters Di and De defined previously (FIG. 3) and considered relative to the inlet and outlet of the adjuster 29 respectively is within the range between 1.8 and 2.5 and preferably close to 2.

The fluid passing through the orifices 22 assumes a certain power value by dint of its passage into the pump P1. At the outlet of the last impeller 26 of the last stage 25 of the pump P1, the fluid has an inherent power E1 greater than the power E0 it had at the inlet 21 of the pump P1 and a substantially radial direction of flow. In addition, because of the compression applied inside the axial-flow pump P1, the ratio of the gaseous phase to the liquid phase has decreased, the value of this GLR ratio being such that the fluid will be efficiently compressed inside the centrifugal pump P2. The fluid therefore has a more uniform distribution of liquid and gaseous phases. It then passes through the adjuster element 29, which imparts to it a flow direction matching the inlet of the pump P2, following an essentially axial direction close to the shaft A2 and as close to the shaft as possible.

In another embodiment, the adjuster element may be an intermediate element which is independent of the axial-flow and centrifugal pumping elements and have characteristics essentially the same as those described in respect of the adjuster 29.

In another embodiment, the usual geometric characteristics are retained for the final adjuster of the last stage, at the outlet of which the fluid is flowing in an essentially axial direction, and an element is disposed between this adjuster and the inlet of the centrifugal pump P2, whose main function is to adjust the flow diameter Di to a flow diameter De.

In all embodiments and in order to define the geometry and the characteristics of this adjuster element, account is taken of the nature and facies of the multi-phase flow and the petroleum flow type from the well or source.

In FIG. 2B, the internal diameters of the bodies of the two pumping elements are also given by references Φ3 and Φ4 respectively.

It is also possible to select different values for these diameters. For example, by choosing a diameter Φ3>Φ4, the flow rate of the fluid from the axial-flow pump P1 to the centrifugal pump P2 will be enhanced. Essentially the same diameter values are used for the two pumping elements if the aim is to produce a certain balance between the flow rate and the pressure. A value lower than Φ4 will be selected for Φ3 in order to enhance the pressure gain produced by the centrifugal stages of the pump P1.

By preference, a range of values will be chosen for the rotation speed that is compatible with the two types of pumps, axial-flow and centrifugal. For example, if the two pumps are joined to a same shaft, the rotation speed selected will vary within the range between 3000 and 5000 r/min, for example, and preferably close to 4500 r/min. In some cases, this rotation speed can be increased to approximately 6000 r/min.

Because of the high rotation speeds and the fact that the proportion of gas may well be high, at least 40% at the inlet of the axial-flow pump P1, for example, it may prove necessary to lubricate some parts of the system and in particular the bearings 28.

Figure 4:
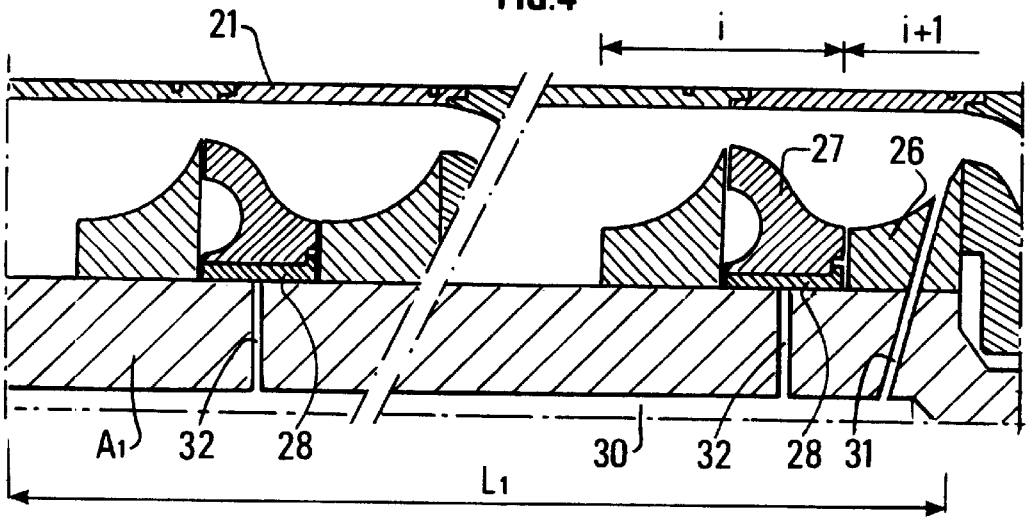
FIG. 4 illustrates an embodiment in which the rotation shaft is provided with a lubricating system.
Figure 5:
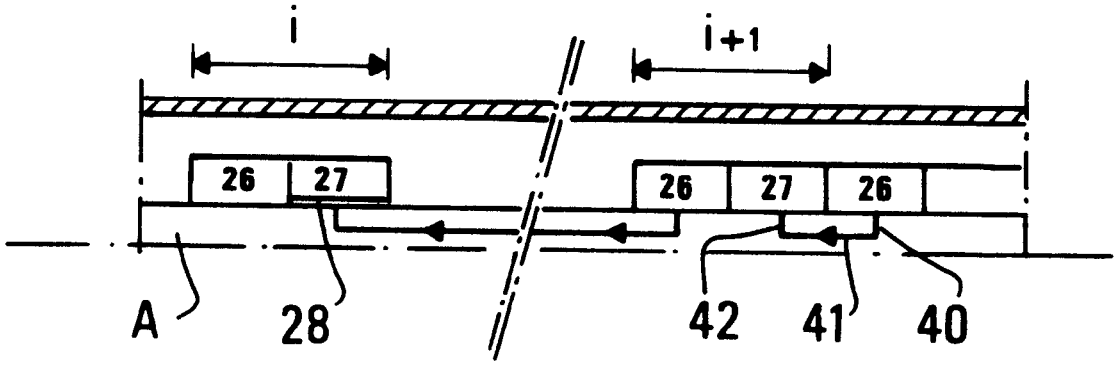
FIG. 5 is another embodiment of the lubricating circuit of FIG. 4.
Figure 6:
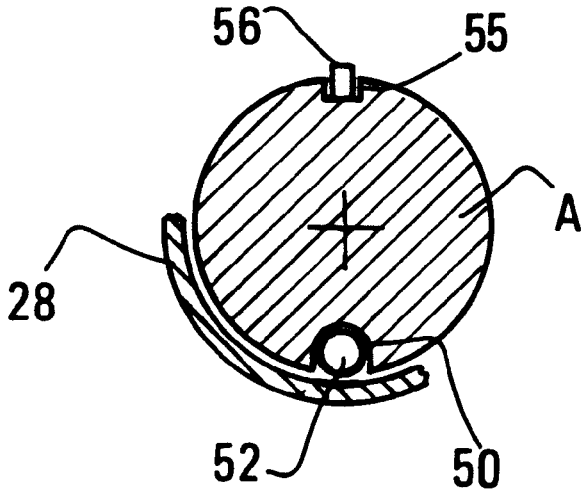
FIG. 6 shows an embodiment which can be used with the lubricating circuits of FIGS. 4 and 5.

With this in mind, FIGS. 4, 5 and 6 illustrate several embodiments, which make use of the high-pressure fluid as a lubricant for the bearings.

At least a proportion of the high-pressure fluid can be drawn off from a compression stage, on a level with the last impeller, for example, and re-injected into one or more lower-ranking stages as viewed from the inlet to the outlet of the pump P1.

In FIG. 4, the shaft A has a hollow passage 30 across the greater part of the length L1 of its portion A1 (at least over the portion of the pump incorporating the compression stages) arranged essentially along the axis of the shaft. The passage 30 is linked by a duct 31 arranged inside the impeller 26 (rank i+1) of the last stage 25 of the pump P1 allowing at least a proportion of the fluid with a pressure F1 to pass through, whilst the remainder is delivered to the pumping device P2.

The central duct 30 links with one or more ducts 32 opening on a level with the bearings 28 of the adjusters of one or more stages, for example the admission stage 24 and the stage ranked i in the drawing. The high-pressure fluid will then lubricate these bearings.

FIG. 5 is a schematic illustration of an embodiment of the device of FIG. 4 which has a specific advantage in that the pressure value of the fluid used as a lubricant is adjusted. In effect, instead of delivering the high-pressure fluid only from the outlet of the pump P1 to the different stages of the system, one or several small circuits are provided which allow the high-pressure fluid to be drawn off from a stage i+1, so that it can be returned to stage i, for example, or to another stage, provided the stage from which the fluid is drawn off is a compression stage of a higher rank.

The drawing-off and re-injection circuits have a duct 40 linked to an impeller 26 of a stage of rank i and a duct 41 essentially parallel with the axis of the shaft, the duct 41 in turn being linked by a duct 42 opening on a level with the bearing 28 of an adjuster 27 of a lower rank i−1 or i−x, x>1.

The circuit or circuits may be distributed substantially along the section P1 of the pumping system. Since the stages located in the vicinity of the admission stage are the ones where the GLR value is highest, the effluent at the inlet has a higher proportion of gas than the effluent at the outlet of the pumping device as a result of the compression action on the interior and therefore a greater number of lubricating circuits may be provided in the region close to the inlet.

In another embodiment illustrated in FIG. 6, the hollow duct arranged at the center of the shaft is replaced by a passage which will be arranged at a point 50 in the shaft.

This approach has the advantage of simplifying the technical design of the system.

To this end, the shaft A has a cavity 50, for example, the geometric dimensions of which are chosen such that a tube 52 can be accommodated, which may be of essentially the same length as the portion of the shaft A1 incorporating the compression stages. This tube 52 has one or more orifices 53, 54 (not illustrated in this drawing), the orifices of type 53 being distributed along the portion A1 to allow the high-pressure fluid to pass from an impeller to the tube 52 whilst those of type 54 will provide a passage from the tube 52 to a bearing 28 of an adjuster to be lubricated. The bearing 28 has means to allow the fluid used as the lubricating agent to pass through towards the adjuster.

The orifices are distributed to match the stages to be lubricated.

In another embodiment, it would not be a departure from the scope of the invention if lengths of tube of type 52 were designed to produce a distribution system for the lubricating fluid such as illustrated in FIG. 5.

The pumping devices of the axial-flow type have a groove 55 on a level with the rotation shaft to receive a key which retains the impeller. Without departing from the scope of the invention, it would also be possible to use the tube 52, illustrated in figure, as the key.

We claim:

1. A pumping system for compressing a multi-phase fluid comprising at least one gaseous phase and at least one liquid phase, the system having in combination at least one pair of pumping elements, comprising:

a first pumping means P1 of the axial-flow type for pumping the multi-phase fluid and for achieving at least one of imparting power to the multi-phase fluid, reducing the proportion of gaseous phase initially present in the multi-phase fluid, and mixing the gaseous and liquid phases, in order to obtain a first fluid F1 with a power E1 at the outlet of the first pumping means P1, a second pumping means P2 of the centrifugal type provided downstream of and operably connected to the said first pumping means P1 for imparting to the said first fluid F1 from the first pumping means P1 a sufficient pressure value to convey it from one location to another, and adjusting means arranged between the outlet of the said first pumping means P1 and the inlet of the said second pumping means P2 for adjusting the fluid F1 in readiness for the second pumping means P2, wherein the first pumping means P1 has several stages, each of the stages having an impeller and an adjuster, the second pumping means P2 having at least one series of centrifugal hydraulics comprising an impeller and an adjuster, and wherein the adjusting means has geometric characteristics of the outlet relative to the inlet to optimize transfer of the fluid F1 to the second pumping means P2, and wherein an angle of entry $\alpha$ of the fluid F1 into the adjusting means relative to a plane perpendicular to an axis of the rotation shaft is within a range between 10 and 30° and an angle of exit $\beta$ of the fluid F1 from the adjusting means relative to the plane perpendicular to the axis of the rotation shaft is 90°+/−10°.

2. A pumping system as claimed in claim 1, wherein the adjusting means is disposed between the impeller of the last stage of the first pumping means P1 and the first impeller of the second pumping means P2.

3. A pumping system as claimed in claim 1, wherein the first and second pumping means P1 and P2 are joined to a same rotation shaft and the rotation shaft comprises at least two parts A1 and A2, one part A1 of a length L1 essentially equal to a length of the first pumping means P1 of the axial-flow type and a second part A2 of a length L2 extending essentially across an entire length of the second pumping means of the centrifugal type, wherein a diameter D1 of part A1 is greater than a diameter D2 of part A2.

4. A pumping system in combination with a petroleum well, comprising the system as claimed in claim 1 disposed in a petroleum well and in such a manner to allow a multi-phase petroleum fluid to be transferred from the bottom of the well to the surface.

5. A pumping system for compressing a multi-phase fluid comprising at least one gaseous phase and at least one liquid phase, the system having in combination at least one pair of pumping elements, comprising:

a first pumping means P1 of the axial-flow type for pumping the multi-phase fluid and for achieving at least one of imparting power to the multi-phase fluid, reducing the proportion of gaseous phase initially present in the multi-phase fluid, and mixing the gaseous and liquid phases, in order to obtain a first fluid F1 with a power E1 at the outlet of the first pumping means P1, a second pumping means P2 of the centrifugal type provided downstream of and operably connected to the said first pumping means P1 for imparting to the said first fluid F1 from the first pumping means P1 a sufficient pressure value to convey it from one location to another, and adjusting means arranged between the outlet of the said first pumping means P1 and the inlet of the said second pumping means P2 for adjusting the fluid F1 in readiness for the second pumping means P2, wherein the first pumping means P1 has several stages, each of the stages having an impeller and an adjuster, the second pumping means P2 having at least one series of centrifugal hydraulics comprising an impeller and an adjuster, and wherein the adjusting means has geometric characteristics of the outlet relative to the inlet to optimize transfer of the fluid F1 to the second pumping means P2, and wherein a ratio Di/De of flow diameters Di of the inlet of the adjusting means to De of the outlet of the adjusting means is within a range between 1.8 and 2.5.

6. A pumping system, for compressing a multi-phase fluid comprising at least one gaseous phase and at least one liquid phase, the system having in combination at least one pair of pumping elements, comprising:

a first pumping means P1 of the axial-flow type for pumping the multi-phase fluid and for achieving at least one of imparting power to the multi-phase fluid, reducing the proportion of gaseous phase initially present in the multi-phase fluid, and mixing the gaseous and liquid phases, in order to obtain a first fluid F1 with a power E1 at the outlet of the first pumping means P1, a second pumping means P2 of the centrifugal type provided downstream of and operably connected to the said first pumping means P1 for imparting to the said first fluid F1 from the first pumping means P1 a sufficient pressure value to convey it from one location to another, and adjusting means arranged between the outlet of the said first pumping means P1 and the inlet of the said second pumping means P2 for adjusting the fluid F1 in readiness for the second pumping means P2, wherein the first pumping means P1 has several stages, each of the stages having an impeller and an adjuster, the second pumping means P2 having at least one series of centrifugal hydraulics comprising an impeller and an adjuster, and wherein the adjusting means has geometric characteristics of the outlet relative to the inlet to optimize transfer of the fluid F1 to the second pumping means P2, and wherein the rotation shaft further comprises drawing-off and re-injecting means for drawing off at least a proportion of high-pressure fluid and means for re-injecting the drawn-off portion on a level with one or more adjusters of the first pumping means P1 in order to lubricate the bearing or bearings associated with the one or more adjusters.

7. system as claimed in claim 6, wherein the drawing-off and re-injection means comprises a tube arranged in a part of the rotation shaft, the tube having a distribution of passages for lubricating the bearings of the adjusters.

* * * * *